US006286725B1

(12) United States Patent
Gerber

(10) Patent No.: US 6,286,725 B1
(45) Date of Patent: Sep. 11, 2001

(54) CONTAMINATION-SAFE MULTI-DOSE DISPENSING AND DELIVERY SYSTEM FOR FLOWABLE MATERIALS

(75) Inventor: Bernard R. Gerber, Santa Cruz, CA (US)

(73) Assignee: Waterfall Company, Inc., Santa Cruz, CA (US)

( * ) Notice: Subject to any disclaimer, the term of this patent is extended or adjusted under 35 U.S.C. 154(b) by 0 days.

(21) Appl. No.: 08/934,040

(22) Filed: Sep. 19, 1997

(51) Int. Cl.[7] ..... B65D 37/00

(52) U.S. Cl. ..... 222/207; 222/213; 222/494; 222/496

(58) Field of Search ..... 222/207, 212, 222/213, 491, 494, 495, 496, 497, 518; 137/903

(56) References Cited

U.S. PATENT DOCUMENTS

| | | | | |
|---|---|---|---|---|
| Re. 34,243 | | 5/1993 | Gerber | 604/247 |
| 1,869,808 | * | 8/1932 | Hancock | 222/496 |
| 3,957,114 | | 5/1976 | Streich | 166/285 |
| 4,067,358 | | 1/1978 | Streich | 137/624.3 |
| 4,286,664 | * | 9/1981 | Bolding, Jr. | 137/903 |
| 5,033,655 | | 7/1991 | Brown | 222/212 |
| 5,080,138 | | 1/1992 | Haviv | 137/853 |
| 5,092,855 | | 3/1992 | Pardes | 604/247 |
| 5,099,885 | | 3/1992 | Nilsson | 137/852 |
| 5,181,571 | | 1/1993 | Mueller et al. | 166/381 |
| 5,265,847 | | 11/1993 | Vorhis | 251/342 |
| 5,305,786 | | 4/1994 | Debush | 137/512.3 |
| 5,346,108 | | 9/1994 | Pasinski | 222/494 |
| 5,392,862 | | 2/1995 | Swearingen | 166/386 |
| 5,398,853 | | 3/1995 | Latham | 222/491 |
| 5,411,049 | | 5/1995 | Colvard | 137/71 |
| 5,573,033 | * | 11/1996 | Litzel | 222/494 |
| 5,636,765 | * | 6/1997 | DeJonge | 222/212 |
| 5,836,484 | * | 11/1998 | Gerber | 222/494 |

FOREIGN PATENT DOCUMENTS

| | | | | |
|---|---|---|---|---|
| 207816 | * | 3/1940 | (CH) | 222/496 |
| 2048827 | * | 12/1980 | (GB) | 222/494 |

* cited by examiner

*Primary Examiner*—Joseph A. Kaufman
(74) *Attorney, Agent, or Firm*—Woodside Intellectual Property Law Group; Michael Hetherington

(57) ABSTRACT

A valve for dispensing the fluid contents of a container such that external contaminants such as dust, air or microbes cannot enter the container even after repeated dispensing cycles. The valve comprises a plug-type valve and an elastomeric sheath type valve such as a flapper valve, slit valve, or duck bill valve. All are one-way devices. The plug is provided with a mechanism for resetting it to the closed position at the end of each delivery cycle such that the plug is a one-way device also. The mechanism can be an elastomeric tether, gravity, or the deformation of a valve part. The plug can be provided with channels or other cut or shaped features, e.g. grooves, to facilitate fluid flow. The container used with this invention must be volumetrically reducible and thereby maintain its own internal pressure at the end of a delivery cycle. Alternatively, the valve of the present invention can be made without the outlet valve i.e., the flapper, slit, or duck bill valve. In this case, the plug is the only one-way valve mechanism.

2 Claims, 10 Drawing Sheets

CONTAMINATION-SAFE MULTI-DOSE DISPENSING AND DELIVERY SYSTEM FOR FLOWABLE MATERIALS

FIELD OF THE INVENTION

The field of the invention relates generally to dispensing systems and devices for delivering flowable materials such as liquids, solutions, dispersions, suspensions, gels, pastes and other fluids. More particularly, the field of the invention relates to a multi-dose dispensing system for delivering doses of flowable materials and preventing the influx of external contaminants during and between deliveries.

BACKGROUND OF THE INVENTION

The dispensing of flowable materials in a contamination-safe manner, especially over prolonged periods of time or in a repetitive manner, e.g., in multiple doses, presents many difficulties. The main problems relate to precise flow control and prevention of back flow or reflux. In a conventional dispensing system, external contaminants easily can enter the container with the back flow at the end of the delivery cycle.

Most collapsible containers for flowable materials have a discharge port such as a hole, nozzle, spout or other type of opening. The contents of the container, such as pastes, liquids or other fluids, exit through the discharge port propelled by internal pressure. This method of dispensing the flowable material is frequently inaccurate and does not prevent the entry of external contaminants into the container. Hence, additional pouring or dispensing devices must be mounted on or in the discharge port when precise control of the dispensing characteristics is desired. These devices must be simple, effective and low-cost, especially if intended for widespread commercial and domestic use.

A number of patents have been issued on flow control valves and devices for heavy industries. For example, Colvard, U.S. Pat. No. 5,411,049 discloses a flow control valve for cementing equipment used in well-boring operations. The valve allows fluid flow in either direction. Swearingen, U.S. Pat. No. 5,392,862 teaches a flow control sub for hydraulic tools used in mud flow drilling operations in oil fields. Mueller et al., U.S. Pat. No. 5,181,571 teach a device and process for well drilling and setting liners for oil, gas and other completions. U.S. Pat. Nos. 4,067,358 and 3,957,114 issued to Streich describe additional valves for cementing operations.

All of the foregoing flow control valves are adapted for heavy machinery in field conditions and can not be adapted to maintain sterility of systems in which they are used. Specifically, such flow control valves are not adapted to ensure one-directional flow (some of the devices, in fact, permit free reflux) and can not be fitted on collapsible containers. Furthermore, these devices contain many parts and are typically expensive, each costing hundreds or thousands of US dollars.

Typically, a dispensing apparatus has a valve mechanism to ensure precise delivery. U.S. Pat. No. 5,033,655 teaches how to dispense fluid products from a non-collapsible container by employing a system with a slit valve. The system admits air to prevent the collapse of the container as fluid is delivered to the user. This has a disadvantage in that external contaminants borne by air are forced into the solution remaining in the container. Clearly, such a dispensing apparatus is not suitable for contamination-safe multi-dose dispensing from a collapsible container.

A simple solution in the form of a squeeze valve with augmented sealing is presented by U.S. Pat. No. 5,265,847.

This apparatus is adapted for a container whose contents are expelled under the force of gravity. U.S. Pat. No. 5,099,885 discloses a flapper valve, which delivers viscous fluids by means of a pump. This solution is not applicable to all types of liquids and fluids. For example, a flapper valve is not appropriate for highly viscous material and is not useable for suspensions or dispersions.

Likewise, in U.S. Pat. No. 5,346,108 Pasinski discloses a gauged dispensing apparatus to deliver a predetermined amount of generally viscous fluid. The apparatus has a flexure with a bi-stable orientation, concave to convex. Airborne contaminants can enter the apparatus as the flexure returns to its original position. In the devices of Vorhis, Nilsson and Pasinski air and its contaminants rush in to replace the volume of the solution discharged. These devices are not claimed to be contamination-safe.

In addition to the shortcomings already mentioned, the above prior art solutions are not specifically designed to prevent back flow. Haviv teaches in his U.S. Pat. No. 5,080,138 a valve assembly relying on a sleeve valve and consisting of multiple components. Back flow is thwarted by a sheath which permits the flowable to flow out of the valve but prevents any back flow into the container. Unfortunately, this device is complicated, costly to manufacture and difficult to assemble.

A simple discharge nozzle is presented by Latham in U.S. Pat. No. 5,398,853. The nozzle is adapted for the delivery of pastes, e.g., toothpaste. Although Latham does attempt to eliminate the transfer of germs between the discharge opening and the secondary surface where the paste is applied, his nozzle will not arrest the influx of bacteria. For example, bacteria can enter when the nozzle is immersed in a solution.

More effective methods of contamination-free dispensing are disclosed in U.S. Pat. Nos. 5,305,786 and 5,092,855 issued to Debush and Pardes respectively. Debush discloses a modification to the applicant's prior U.S. Reissue Pat. No. 34,243 relying on an expandable elastomeric sleeve tightly fitted about a valve body with entry and exit ports. Debush's improvement is aimed at simplifying the assembly. Unfortunately, his solution requires more material and considerably increases the cost of manufacturing the valve. In addition, it is difficult to produce a discoid-shaped valve while at the same time adapting the apparatus to collapsible containers. Pardes discloses a rigid enclosing sleeve to retain the elastomeric sheath against the valve body, thus providing a seal between the sheath and the valve body. This is closely related to the applicant's teaching in U.S. Reissue Pat. No. 34,243. Pardes' valve operates through two sets of ports within a valve body, thus rendering the device and its manufacture unnecessarily complex.

The foregoing solutions have disadvantages in that they cannot be downsized for small containers. The ratio of length to diameter is large and thus limits the volume of flow for small containers.

None of the prior art dispensing devices are low-cost, simple in construction and capable of delivering a flowable material ranging from low to high viscosity in multiple doses in a contamination-safe manner.

In view of the foregoing, it is apparent that what is needed is a system which provides a multi-dose dispensing system for flowable materials in which the sterility or purity of the flowable material is preserved. In particular, the system of the present invention prevents contaminants from passing backwards through the valve into the reservoir of flowable material.

What is also needed is a simplified system for dispensing a flowable material without airborne contamination which is adaptable, simple in construction and mountable on or in any container of the type which maintains its own internal pressure, i.e., not produce a substantial internal vacuum when the flowable material is dispensed. Examples of such containers are volumetrically reducible containers such as a flexible tube, flexible bag or a flexible bottle. The container also could be a vented rigid container including a flexible bag of flowable material.

What is also needed is an improved system for preventing air or airborne contaminants from entering a flowable material comprising a powder such as talc, or the like. The system should also be applicable to a medicine delivered as a powder or aerosol where it is important to prevent airborne contamination from fibers, dust, pollen, microorganisms, or like forms of airborne contaminants.

Other objects and advantages of the invention will become apparent upon reading the detailed description of the invention.

SUMMARY

The foregoing objectives are achieved by using a plug valve separately or in combination with a one-way outlet valve such as a flapper valve, duck bill valve or slit valve at the outlet port. In the plug valve, the plug can move between an open position and a closed position. Fluid pressure on the inlet side of the valve causes the plug to move from the closed position to the open position. A means for applying a restoring force is provided for returning the plug to the closed position at the end of each delivery cycle. The flapper valve at the outlet port comprises two leaves of flexible, elastomeric material in contact that are pushed apart when fluid is flowing through the valve. The leaves squeeze together after each delivery cycle, closing the outlet port. Thus, both the plug valve and the outlet valve are one-way devices. Slit valves and duck bill valves function similarly. In tandem, the two components function to assure one-way fluid flow without suck-back.

The restoring force for returning the plug to the closed position can be provided by an elastomeric tether attached to the housing. The tether is stretched when fluid flow forces the plug to its open position.

Gravity can also be used to provide the restoring force. In this embodiment, the valve must be oriented vertically. The preferred direction will depend upon the buoyancy of the plug in the fluid material and the viscosity of the fluid.

A third option for providing the restoring force is an elastic deformation of the housing or plug. The valve may be constructed such that the housing or plug is forcibly deformed by fluid pressure at the inlet port, opening the valve. Relaxation of fluid pressure at the valve inlet allows the housing or plug to return to its rest shape, which pushes the plug to its closed position. In this embodiment, either the housing can be made rigid and the plug deformable, or the plug can be made rigid and the housing deformable.

The plug can be provided with an annular ring that fits into an annular groove on the inside of the housing. In this way, the housing defines the range of motion of the plug. If the plug is made of an elastomer and the annular ring is bonded to the housing, then the elastic deformation of the plug can provide the required restoring force. Alternatively, the housing can be made deformable and the plug rigid to achieve the same result. In either case, channels such as through-holes must be provided in the valve plug to provide a path for fluid flow.

Preferably, the valve is made of moldable plastic materials such as styrene-butadiene-styrene, silicone, urethane, rubber, polyethylene, polymethylmethacrylate and the like.

The fluid reservoir (container) used with the present invention must be of a type that does not create a substantial internal vacuum when fluid is expelled. In other words, the container must be collapsible or reducible and not replace expelled fluid with outside air. Examples of suitable containers include bags, pouches, syringes, pistons, bellows-type containers and collapsible tubes.

The valve plug can have many different shapes with useful features. Through-holes, grooves, slots, or irregular features can be cut into the valve plug to provide a path for fluid flow when the valve plug is in the open position. This is beneficial because the top of the valve plug may close the outlet port if the fluid pressure at the inlet port is too high, blocking fluid flow. Cut or molded features in the top of the valve plug will prevent blockage of the outlet port in such cases.

The valve plug may also have an elongated tail. This tail will prevent the valve plug from becoming rotationally misaligned with respect to the housing. Rotational alignment is a necessary consideration in the cases where the valve plug has holes or cut features to conduct fluid flow. Also, the tail can serve to seal off the inlet port of the valve.

The present invention can be attached to the fluid container using several well known techniques such as a screw attachment, snap fitting, heat seal, or glue seal. The valve may be permanently attached to the fluid container.

It will be appreciated that an aspect of the present invention includes the integration of the valve for preventing air or airborne contamination with a flexible container of a flowable medium. Accordingly, an aspect of the invention provides an integrated system for the metered delivery or dispensing of a flowable product without contamination by air or airborne materials. This has the advantage of enabling a fluid material to be reformulated without the need for preservatives, hygroscopic agents or antioxidants. Thus, a system according to this aspect of the invention has particular application to the delivery of medications, beverages, or any flowable material in which it is important to prevent airborne contamination.

In accordance with another aspect of the invention, the simplicity of the plug permits a valve to be optimized in its geometry, location, dimensions, and hardness in order to achieve an optimized and desired cracking pressure for delivery of the flowable medium. For example, such an optimized cracking pressure is important in dispensing a carbonated beverage. A higher cracking pressure would be necessary in order to offset the pressure caused by carbonation. An aspect of the present invention enables cracking pressure to be optimized for a particular application.

FIGS., 6A–6D are cross sectional side views of embodiments in which the valve plug has a tail.

Figure 6A:
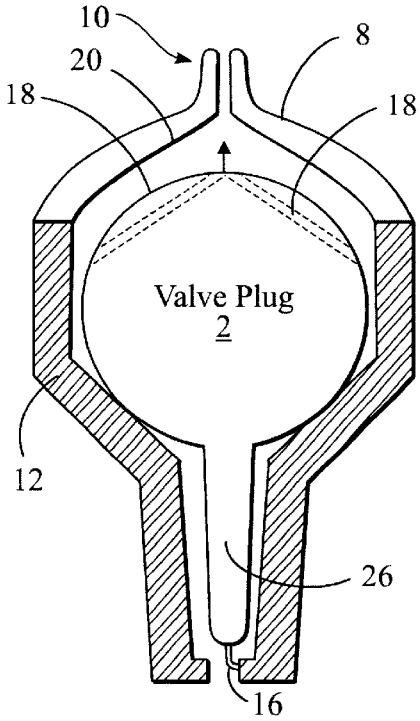
Figure 6B:
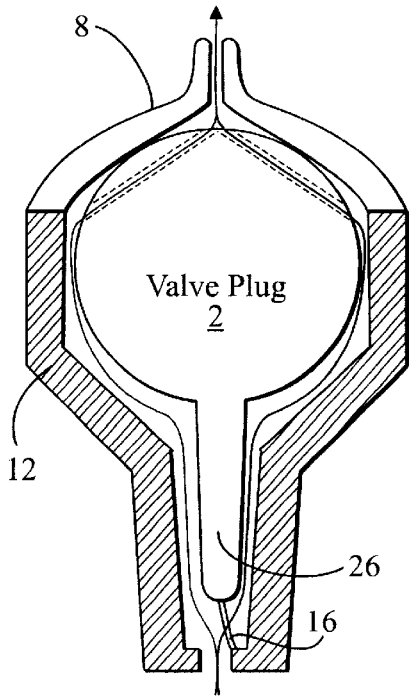
Figure 6C:
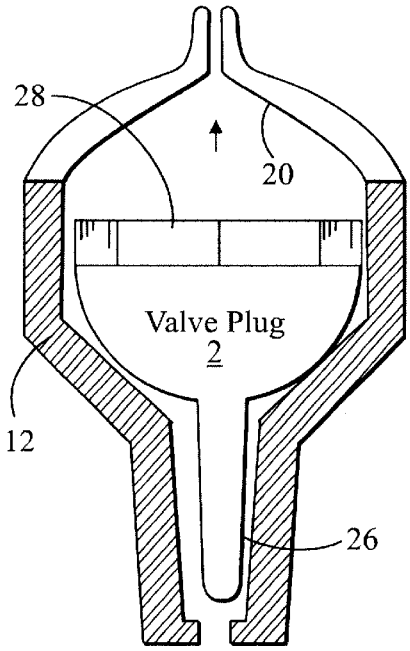
Figure 6D:
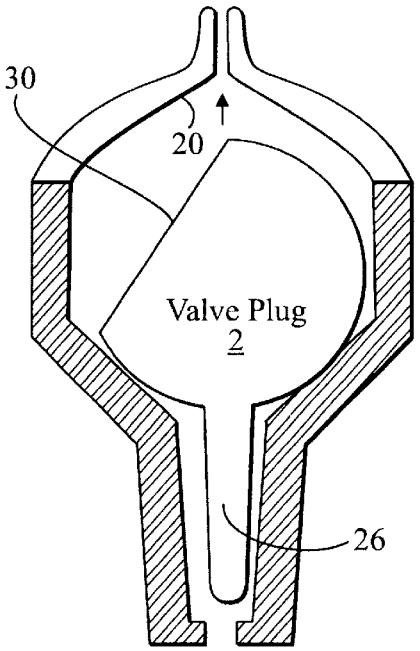
Figure 7A:
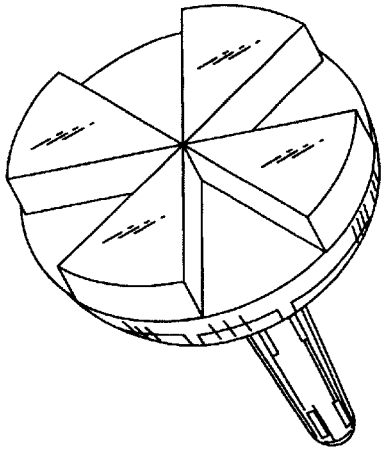
Figure 7B:
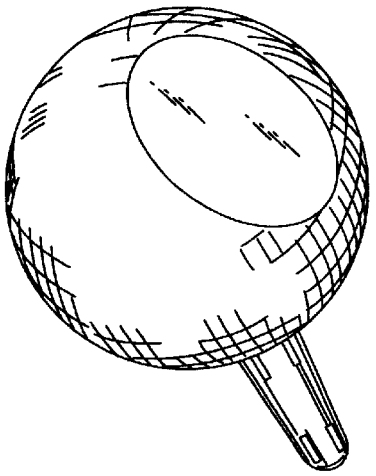

FIGS. 7A–7B further illustrate the features of the valve plugs of FIGS. 6C and 6D.

Figure 8A:
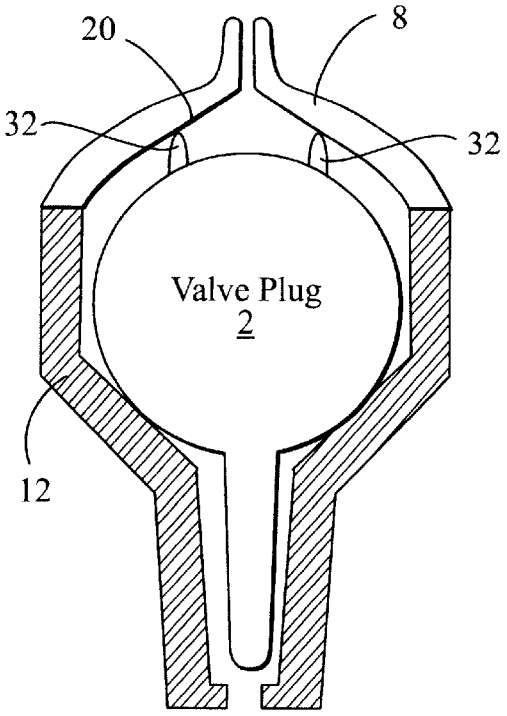
Figure 8B:
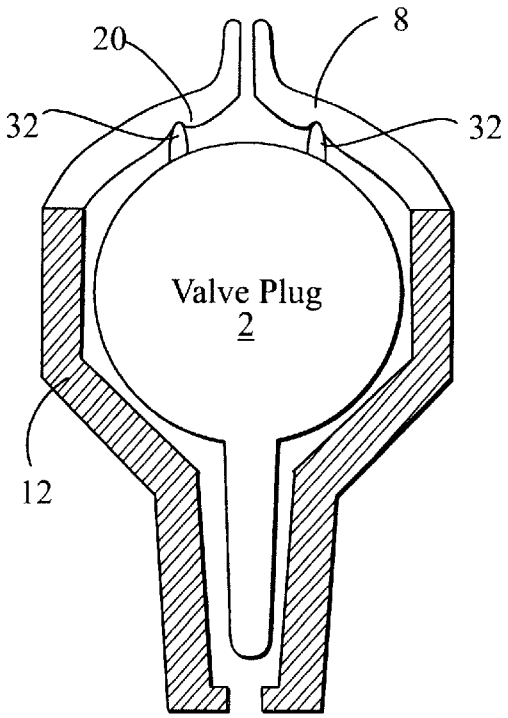

FIGS. 8A–8B are cross sectional side views illustrating how appendages can be used to provide the restoring force.

Figure 9A:
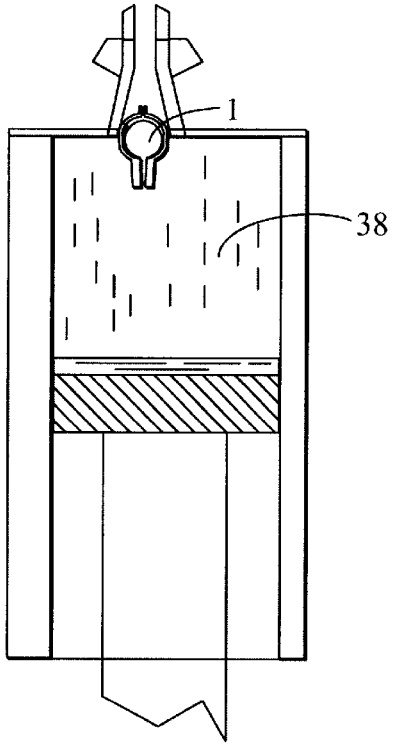
Figure 9B:
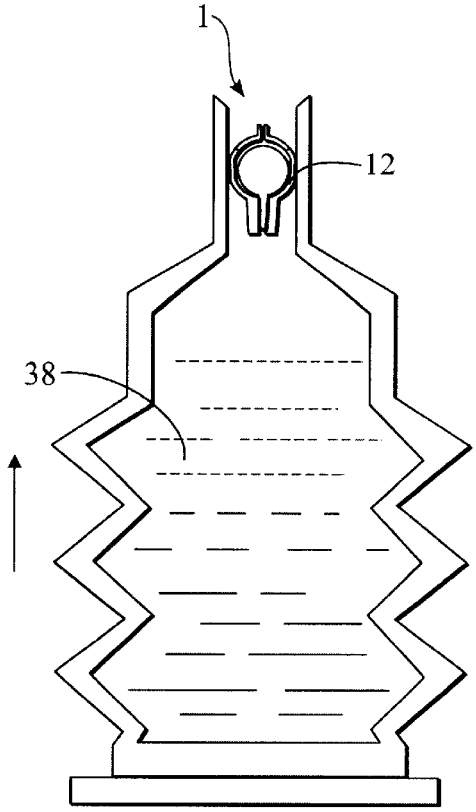
Figure 9C:
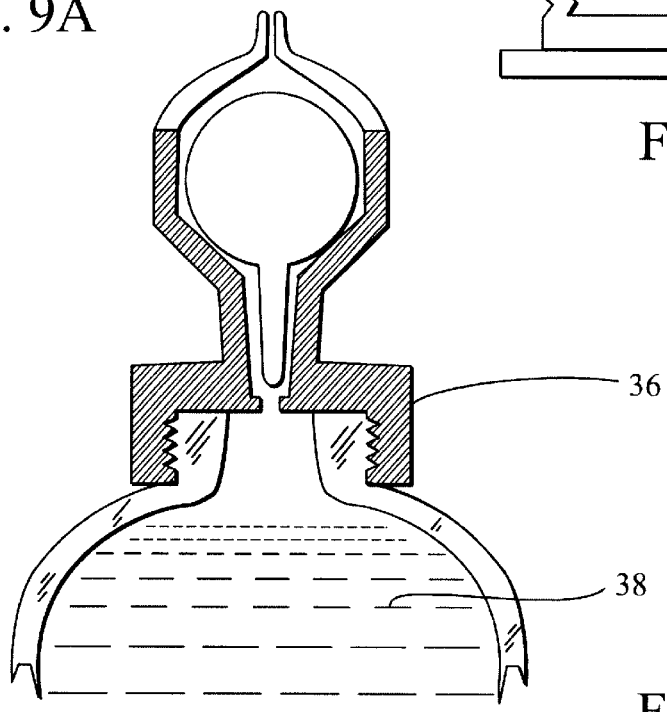

FIGS. 9A–9C are cross sectional side views illustrating how the present invention can be used with different kinds of collapsible or reducible containers.

Figure 10A:
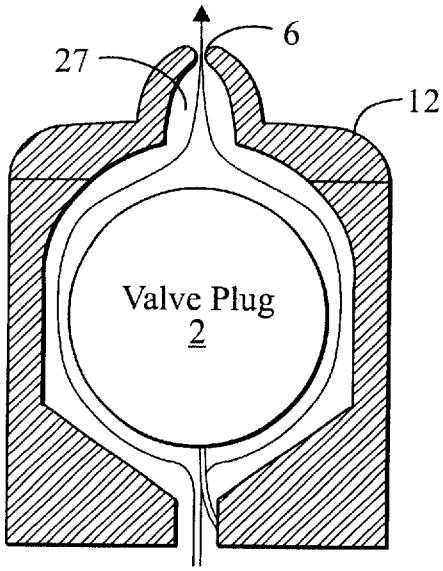
Figure 10B:
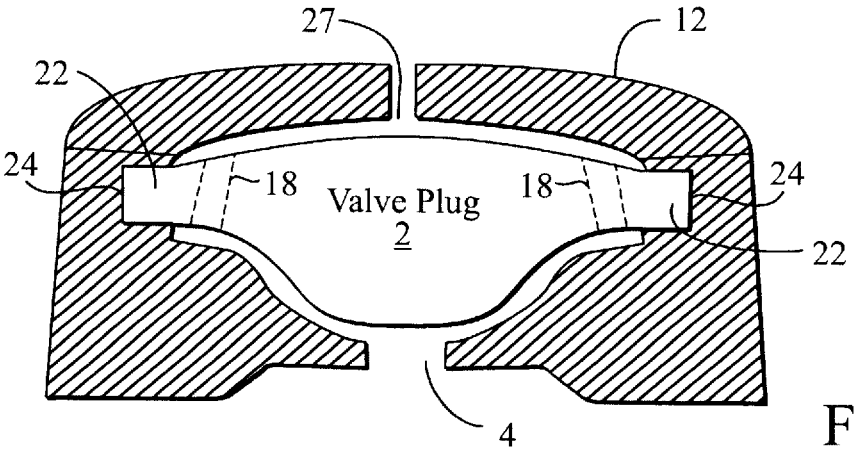
Figure 10C:
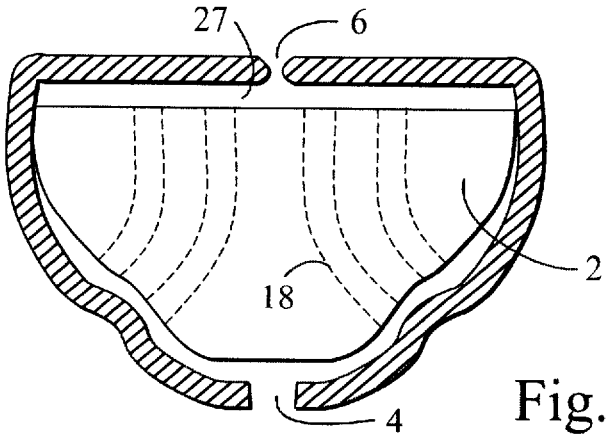

FIGS. 10A–10C are cross sectional side views of valve embodiments that do not include a one-way valve at the outlet port.

Figure 11A:
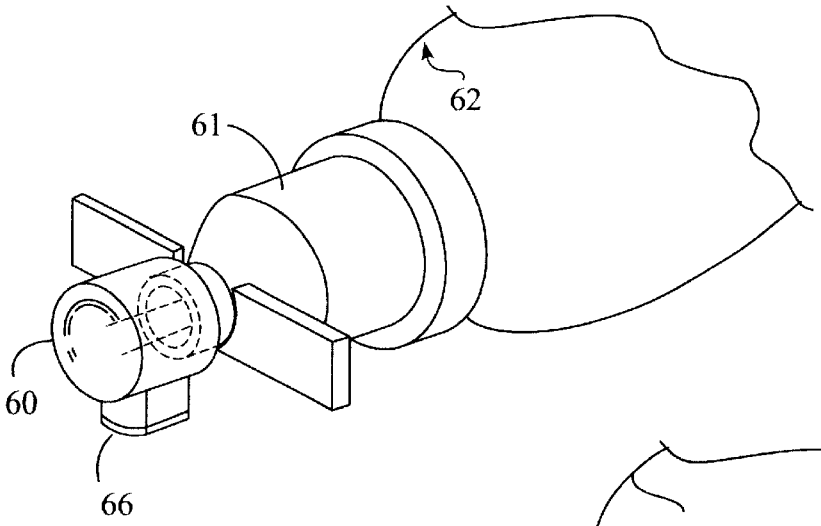
Figure 11B:
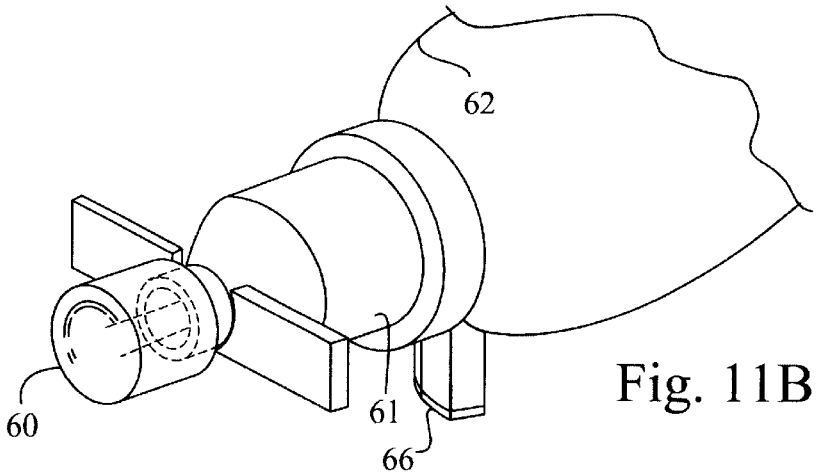
Figure 11C:
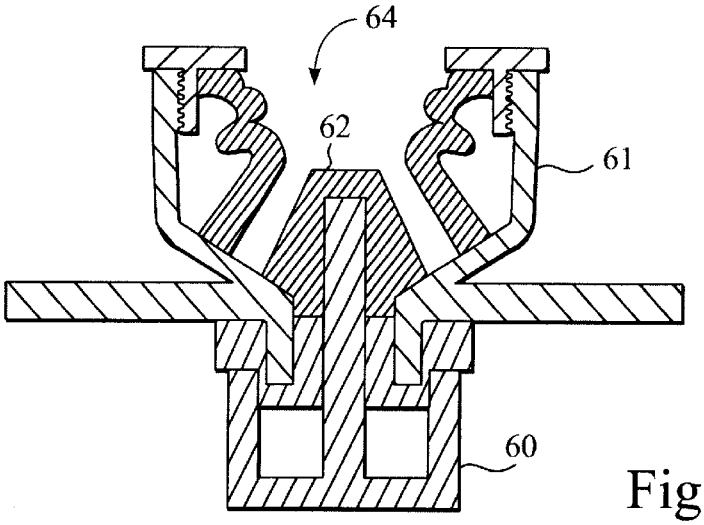

FIGS. 11A–11C show a finger actuated piston, such as an aspirated pump, for dispensing a bulk material, an aerosol medication, or other flowable material.

DETAILED DESCRIPTION

Figure 1A:
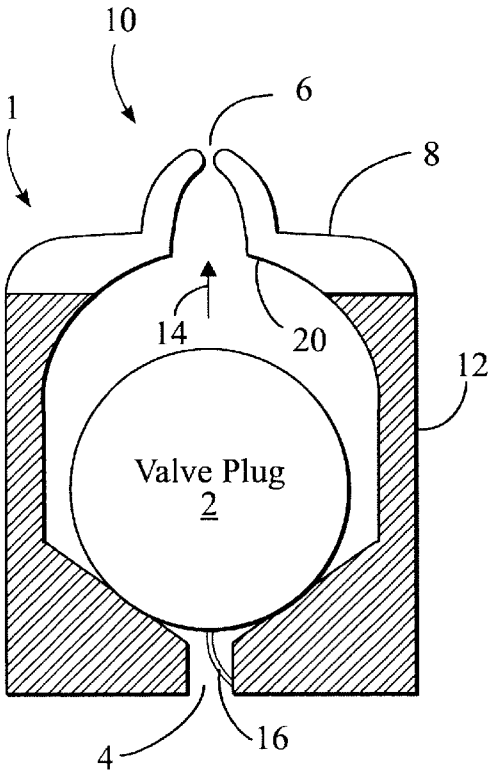
FIGS. 1A–1C are cross sectional side views of an embodiment using a tether and spherical valve plug.
Figure 1B:
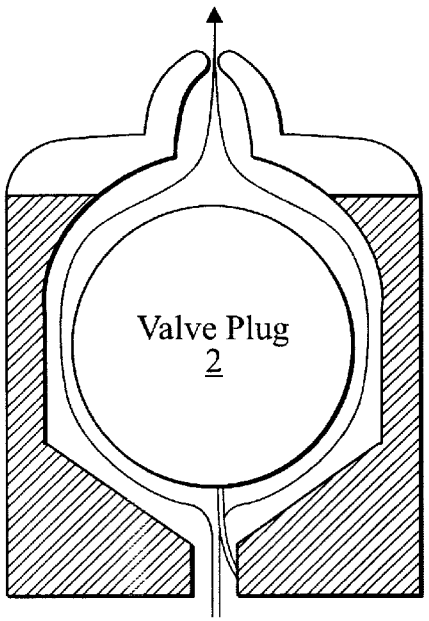

The cross sectional side views of FIGS. 1A and 1B illustrate the general operating principles of the valve 1 in accordance with an aspect of the present invention. FIG. 1A shows a plug 2 in a closed position and FIG. 1B shows plug 2 in an open position. The inlet port 4 is at the bottom and the outlet port 6 is at the top. Plug 2 can be made from either elastomeric or rigid materials such as moldable plastics, depending upon the embodiment. An upper portion 8 of the housing is made of an elastomeric sheath and forms a one-way outlet valve 10 such as a slit valve. A lower housing body 12 (shaded portion) is made of a rigid material. The lines and arrows in FIG. 1B indicate the path the flowable material (fluid) takes when flowing from inlet port 4 to outlet port 6.

It is noted that all parts of the present invention that are made with elastomeric materials are resilient and return to their original shape if deformed.

Slit valves 10 comprise two thin leaves of elastomeric material that are in contact when no fluid is flowing between them. The leaves have a built-in tendency to press together supplemented by aspects of the inner surface of the housing. Fluid pressure pushes the leaves apart, creating an opening for fluid flow. Similar devices such as duck-bill valves and flapper valves can also be used as the one-way outlet valve 10. Flapper valves, slit valves and duck bill valves are well known in the art.

Plug 2 must be displaced in the direction of the arrow 14 (upwards) in order for the fluid to flow through the valve. The force required for the plug 2 displacement is provided by the fluid pressure at the inlet port 4. In all the embodiments of the present invention, a restoring force is provided which returns the plug 2 to the closed position at the end of each delivery cycle. The embodiment of FIG. 1A and 1B uses an elastomeric tether 16 attached between the housing body 12 and plug 2 to provide such restoring force. The elastomeric tether 16 has the advantageous feature of preventing plug 2 from rotating (about an axis perpendicular to the plane of the paper). For plugs 2 that have channels such as through-holes 18 or grooves, this can be necessary.

Figure 1C:
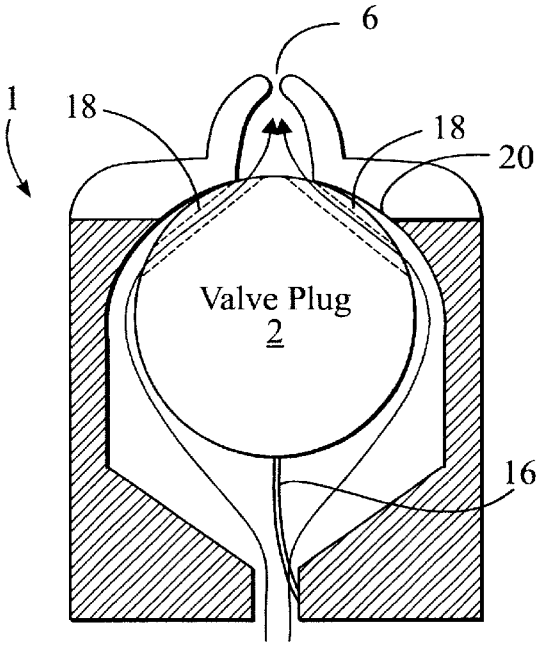

FIG. 1C illustrates a valve plug with through-holes 18 that conduct fluid flow. Through-holes 18 prevent the contact between upper housing surface 20 and plug 2 from impeding the flow of fluid. Lines with arrows indicate the flow path through the valve 1. In normal operation, fluid may flow both through the holes 18 and around plug 2 as in FIG. 1B. It is noted that the plug 2 (more specifically the holes 18) in this embodiment must maintain proper rotational alignment with the housing 8, 12. This is provided by the tether 16. Alternatively, plug 2 may have grooves or irregular cut or protruding features to perform the same function as the holes 18, i.e., maintaining a flow channel between plug 2 and upper housing surface 20. All the through-holes 18 used in the present invention conduct fluid flow, and, as such, extend through plug 2.

In all embodiments of the present invention, plug 2 is forcibly held in a closed position by the restoring force (elastomeric tether 16 in above embodiment) unless acted upon by increased fluid pressure at the inlet port 4. Plug 2 is in contact with the inside surface of the housing 12 when in the closed position. Increased pressure causes plug 2 to move toward the outlet port 4, opening a pathway for fluid flow. The tether 16 stretches as the plug 2 moves into the open position. Plug 2 may contact the upper housing surface 20, in which case holes 18 conduct fluid flow. After flowing around valve plug 2 or through holes 18, the fluid exits the valve 1 through slit valve 10. When the delivery cycle is completed and the fluid pressure at the inlet port 4 returns to ambient, the tether 16 pulls plug 2 to the closed position Since plug 2 and the slit valve 10 are one way devices, valve 1 has two one-way mechanisms acting in concert to assure contamination-safe dispensing of fluids.

Other embodiments of the present invention can use gravity or elastomeric valve parts (valve plug 2 or housing 8, 12) to provide the restoring force. Gravity can only be used as the restoring force in applications where the valve is oriented vertically and the fluid is not too viscous so as to prevent the return of plug 2 to its closed position in a reasonable amount of time. It is noted that the restoring force must always be in a direction opposite to the flow of fluid. This is because fluid flow causes valve 1 to open in all the embodiments.

Figure 2A:
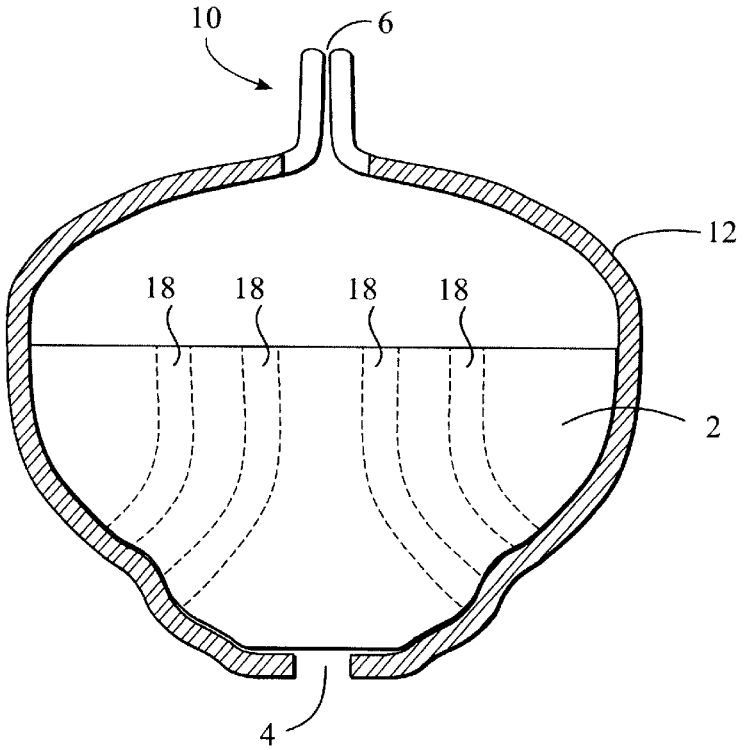
FIGS. 2A–2B are cross sectional side views of an alternate embodiment with the plug valve in the closed and open positions.
Figure 2B:
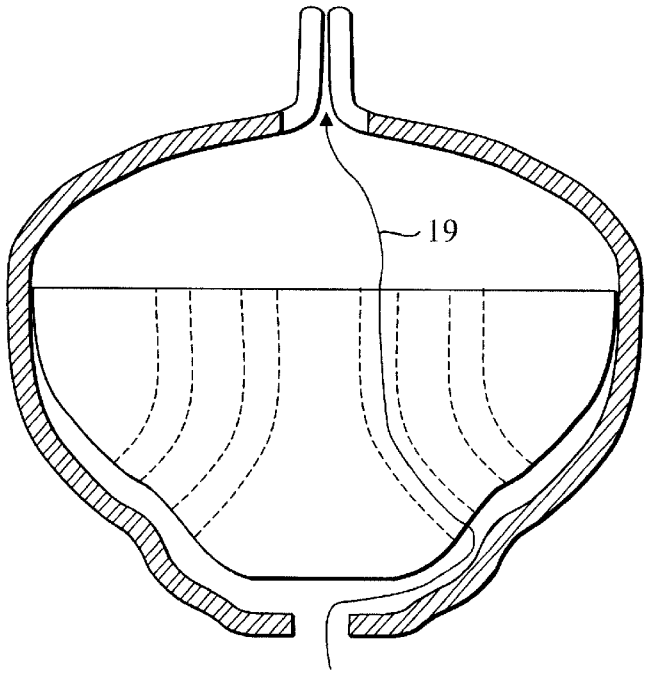

FIGS. 2A and 2B illustrate closed and open positions of another embodiment. In this embodiment, the plug 2 is an odd shape with several holes 18 for the flow of the fluid. All the fluid flows through the valve plug holes 18 and none flows around the valve plug 2, as in the embodiment of FIG. 1B. A line and arrow 19 indicate the flow path through one of the holes 18. It can be seen that the range of motion of plug 2 is limited by the curvature of the housing body 12. In this embodiment, the restoring force can be provided by an elastic tether, gravity, or elastomeric mechanisms described below.

Figure 3A:
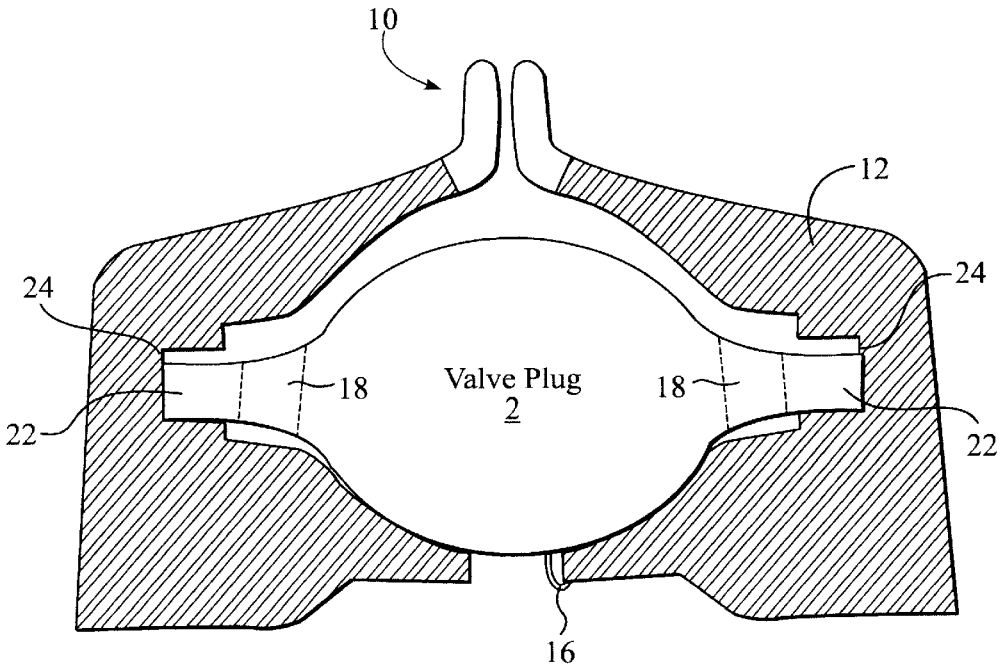
FIGS. 3A–3B are cross sectional side views of an embodiment in which the plug has an annular ring engaged in an annular groove in the housing.
Figure 3B:
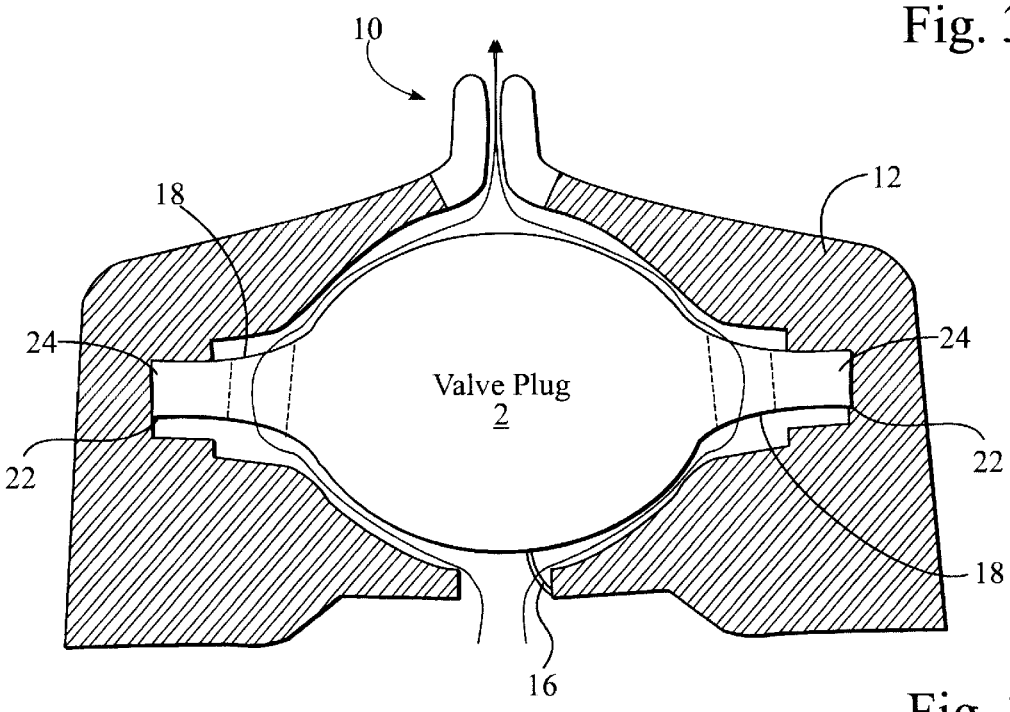

FIGS. 3A and 3B are cross sectional views illustrating an alternative method of mounting plug 2 in the housing body 12. FIG. 3A shows the closed position and FIG. 3B shows the open position. One or more holes 18 in the valve plug 2 conduct fluid flow. A line with arrows shows the fluid flow path through the valve. The plug 2 is provided with an annular ring 22 which fits loosely into an annular groove 24 on the inside surface of the housing body 12. The mechanical relationship between the annular ring 22 and annular groove 24 restrains the motion of the valve plug 2 but allows for distinct open and closed positions of the valve plug 2. The restoring force can be provided by a tether 16, gravity, or elastomer mechanisms described below. This embodiment also uses a second one-way valve such as a duck bill valve 10 at the outlet port.

Figure 4A:
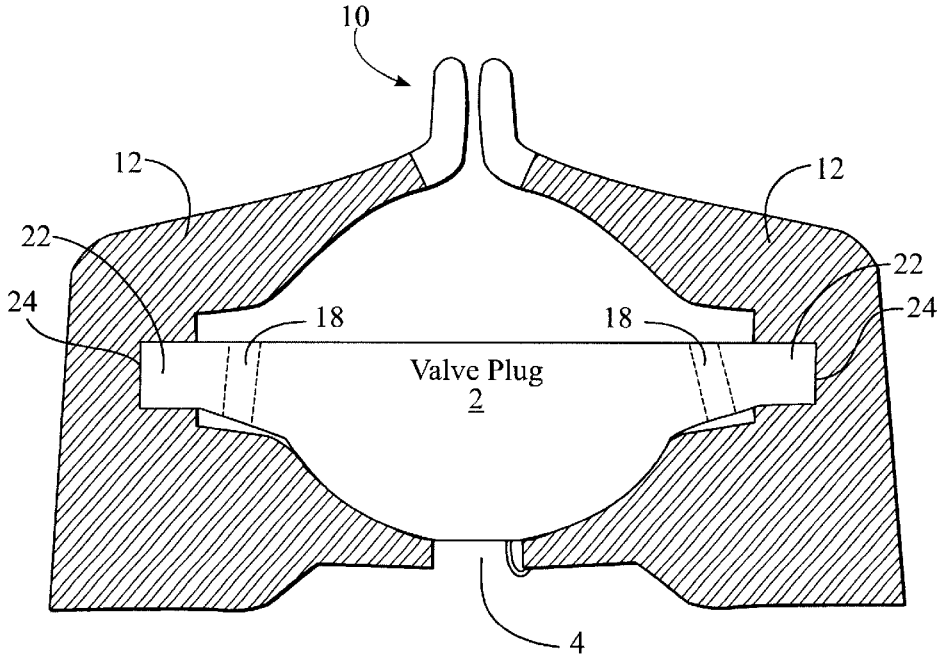
FIGS. 4A–4B are cross sectional side views illustrating how elastic deformation of the valve plug can provide the necessary restoring force.
Figure 4B:
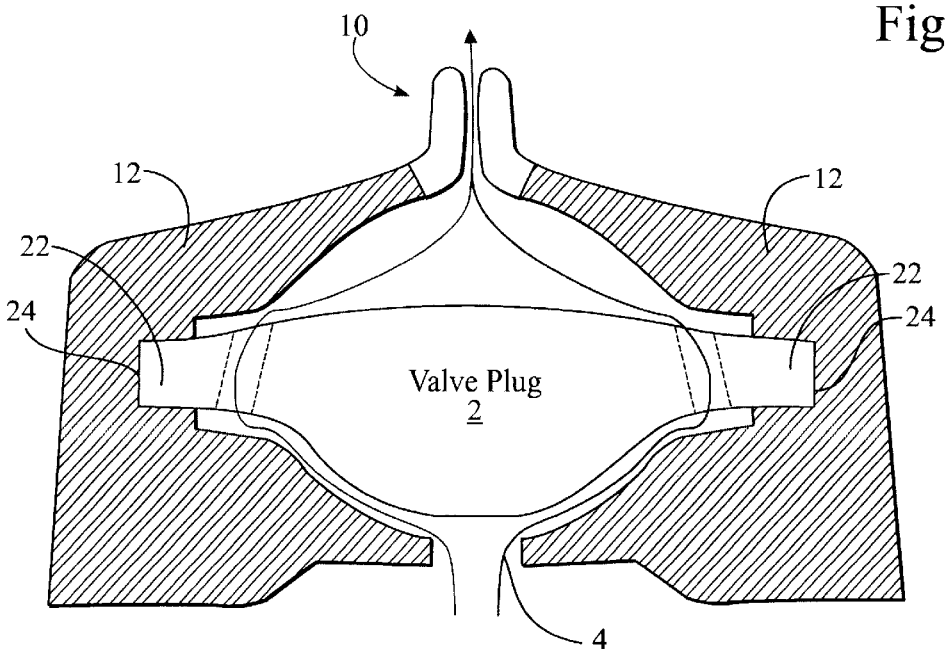

FIGS. 4A and 4B illustrate the closed and open positions of an embodiment similar to the embodiment of FIGS. 3A and 3B. The difference is that the restoring force is provided by the reversible deformation of plug 2, which is made of an elastomeric material. The elastomeric material of plug 2 must be resilient enough to return to its original shape after repeated deformations. The housing body 12 is rigid in this embodiment. The annular ring 22 of plug 2 is held securely in place by the annular groove 24. The annular ring 24 holds valve plug 2 to housing body, while still allowing the valve plug 2 to deform. The motion of the valve plug 2 is allowed by the deformation of the annular ring 22 due to pressure exerted by fluid flowing through the inlet port 4. The valve is constructed such that when plug 2 is not deformed, the valve is in its the closed position. Fluid flow through the valve deforms plug 2 and pushes it into an open position. The plug must have holes 18 to conduct fluid flow.

Figure 5A:
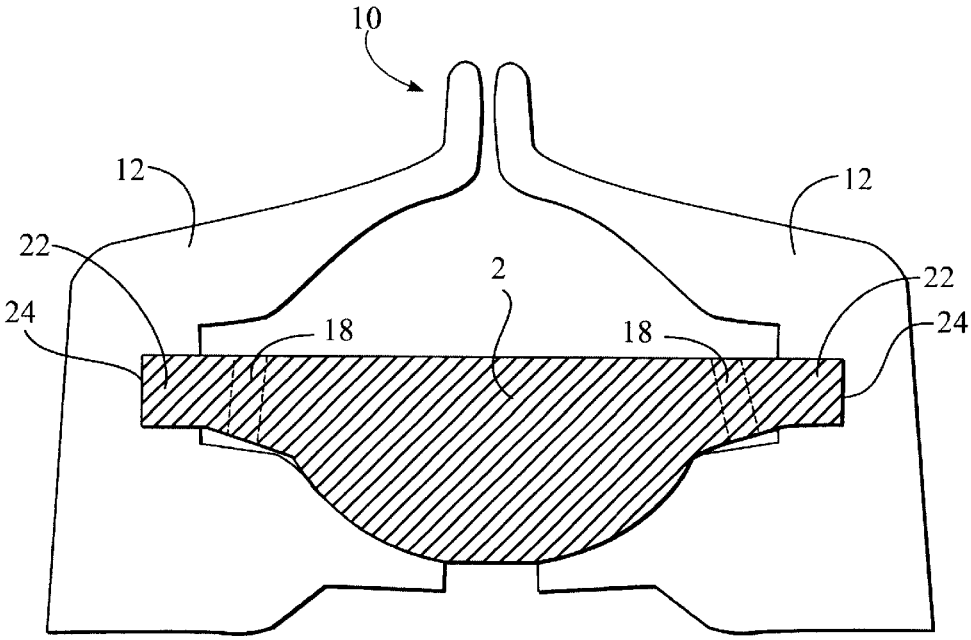
FIGS. 5A–5B are cross sectional side views illustrating how elastic deformation of the housing can provide the necessary restoring force.
Figure 5B:
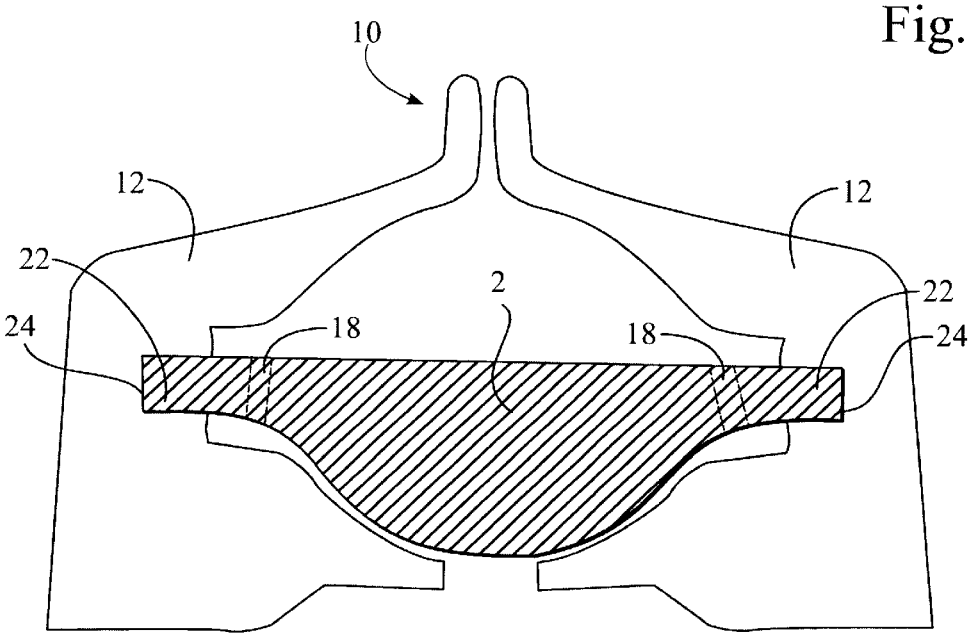

An alternative embodiment is shown in FIGS. 5A and 5B, which show the closed and open positions, respectively. Here, the housing body 12 is made of an elastomeric material and the valve plug 2 is made of a rigid material. Plug 2's annular ring 22 is fixedly mated in the annular groove 24. Plug 2 is allowed to move between open and closed positions by the elastic deformation of the housing body 12 in the vicinity of the annular groove 24. Plug 2 has holes to conduct fluid flow.

FIGS. 6A, 6B, 6C, and 6D illustrate the preferred embodiment of the present invention in which the plug has a tail 26. The tail 26 prevents rotational misalignment of plug 2. In this embodiment, the tether 16 can be attached at the bottom of the tail 26. The upper portion of the housing 8 is made of an elastomer and forms a duck bill or flapper valve; the housing body 12 is made of a rigid material. Since proper rotational alignment of the valve plug 2 is assured, the valve plug 2 can effectively use channels such as holes or grooves for conducting fluid flow. FIG. 6A shows a valve, using a plug 2 with holes 18, in the closed position. FIG. 6B shows a valve, using a plug 2 with holes 18, in the open position. The lines and arrows of FIGS. 6A and 6B indicate the fluid flow path. FIG. 6C shows a valve using a plug 2 with cut wedge-like grooves 28, in the closed position. FIG. 6D shows a valve, using a plug 2 with a cut Planer facet 30, in the closed position. The lines and arrows of FIG. 6B indicate the fluid flow path. FIGS. 7A and 7B further illustrate the plugs of FIGS. 6C and 6D, respectively. The cut-out sections 28 of plug 2 will maintain an open flow channel if plug 2 contacts the upper inside surface 20 of the housing.

An alternative method for providing the necessary restoring force for the valve plug 2 is shown in FIG. 8A (closed position) and FIG. 8B (open position). Here, the valve plug 2 has appendages 32 which are in contact with the upper housing surface 20. When the upper portion 8 of the housing is made of an elastomer, it is constantly pushing down on the valve plug 2 via the appendages 32. The appendages 32 of plug 2 can be many different shapes and can be made of elastomeric or rigid materials. If the appendages 32 are made of an elastomer, they can deform to provide or contribute a restoring force to the valve plug 2. Alternatively, the appendages 32 can be attached to the interior upper housing surface 20 and face downwards. The appendages 32 can also perform the same function as the holes 18, maintaining an open path for fluid flow.

In accordance with an aspect of the invention, the appendages 32 can be calibrated in terms of their dimensions, geometry, or elastomeric response in order to provide an optimized or desired cracking pressure for a particular flowable medium. For example, in the case of a carbonated beverage it is desirable to provide a reasonably high cracking pressure in order to offset the pressure due to carbonation. In this case, it is a simple matter to change the geometry or elastomeric response of the appendages or of the tether and plug in order to provide a desired cracking pressure.

The cracking pressure is defined herein to be the pressure required to open the container of flowable material. In accordance with an aspect of the invention, it is a simple matter to change the geometry of the tether, appendages, or the geometry and position of the plug in order to provide an optimized cracking pressure for a given flowable medium.

It is noted that the appendages 32 as shown in FIGS. 8A and 8B can also be used with the embodiments of the present invention that have annular rings i.e., the embodiments of FIGS. 3, 4, and 5.

FIG. 9A shows the valve 1 of the present invention mounted inside the output spout of a syringe or piston. The valve housing 12 can be bonded to the syringe with adhesive, or attached using a luer-lock fitting. FIG. 9B shows the plug valve 1 mounted in the outlet spout of a bellows-type container. Alternatively valve 1 can be mounted inside the neck of a tube. FIG. 9C shows a plug valve 1 with a screw-on connection 36 attached to the outlet spout of a collapsible or reducible tube-type container. These applications provide for contamination safe dispensing of the fluid contents 38 of the containers.

Another alternative for using the present invention is to combine the container neck and valve housing into a single part. In other words, the housing becomes part of the container.

An alternative embodiment of the present invention uses just the valve plug 2 as the one-way valve mechanism. In other words, the one-way outlet valve 10 (flapper, slit, or duck bill valve) is eliminated. The outlet valve 10 is replaced with a simple opening. All the embodiments described above can be built without the outlet valve 10. An example of such a valve using just a valve plug 2 with an elastomeric tether 16 is shown in FIG. 10A. In this embodiment, the entire housing 12 is made of a rigid material and hence no one-way valve action occurs at the outlet port 6. It is advantageous to design the valve with as small an outlet chamber 27 as possible to minimize the amount of dispensed fluid that is residual in the valve after a discharge cycle. This is because residual fluid in the outlet chamber 27 will not be protected from contamination due to the absence of the outlet valve 10. FIG. 10B shows a valve constructed according to this embodiment wherein the housing 12 has an annular groove 24 and the valve plug 2 has an annular ring 22. The housing 12 is made entirely of rigid material and the volume of the outlet chamber 27 is minimized. FIG. 10C shows yet another example of this embodiment.

FIG. 11 shows an example of a finger activated piston which would be used in a bulk dispensing system or an aspirated pump. Referring to FIGS. 11A, 11B and 11C, a piston 60 is provided for overcoming an internal pressure within a container 61 holding a quantity of flowable material. When the piston 60 is pressed, valve 62 is opened and a quantity of flowable material moves from region 64 and into an outlet 66. Outlet 66 may be provided at the location shown, and also may be provided at any convenient location. For example, outlet 66 may be connected to the finger-activated piston, FIG. 11B or connected directly to housing 61. Restoring piston 60 to its original position closes valve 62 and prevents delivery of the flowable material. The piston can be restored to its original position by a spring, elastomeric tether or other means for providing a restoring force which are well known to one skilled in the art.

It will be appreciated that this aspect of the invention provides an aspirated pump for dispensing flowable material without the contamination of air or airborne contaminants due to a back flow into the material.

The foregoing valves may be used for the delivery of bulk quantities of a flowable material. Bulk quantities of flowable material are conventionally dispensed through an outlet port. An aspect of the present invention eliminates the need for a peristaltic pump. Rather, a valve according to the present invention as previously described with reference to FIGS. 1–10 may be incorporated internally within a collapsible reservoir.

When the nozzle is in the open position, the valve provides a gravity feed of flowable material through the nozzle. At the same time, the reservoir collapses in direct proportion to the quantity of fluid delivered. In this embodiment, the hydrostatic head of fluid in the collapsible reservoir provides the pressure for delivering product through the cartridge. The valve prevents airborne contamination due to back flow as previously explained.

The valve enables the hydrostatic head of fluid itself to provide an expulsion force. In conventional methods for delivering bulk material, a peristaltic pump or other mechanical device must be provided for actively discharging the material. This aspect of the invention requires the fluid-holding container to be volumetrically reducible or collapsible. The container must not generate an excessive internal vacuum when contents are dispensed.

The attachment means, valve materials and specific valve type will depend upon the fluid being dispensed, the container type considered and other variables. It will be obvious to one skilled in the art how to adapt the present invention to different applications.

In many applications it is preferred that the valve be permanently bonded to the container, forming an integrated delivery or dispensing system. Such a system is of great value in dispensing fluids intended for home use, industrial use, or institutional use. That is because the consumer can be offered a ready-to-use product for delivering multiple doses in a contamination safe manner.

It will be appreciated that the foregoing aspects of the invention provide a system for dispensing and delivering a wide range of flowable media including liquids, solutions, mixtures, suspensions, and dispersions. These fluids can be either volatile or nonvolatile, aqueous or nonaqueous, and classified as inorganic or organic fluids as well as combinations of these. With appropriate selection of materials for the component parts to be used in each specific application, the present invention has application as a dispensing and delivery system for fluids in any industry.

The dispensing system advantageously protects the fluid from the adverse effects of evaporation, oxidation, and hydrolysis and advantageously prohibits the entry into the fluid within the dispensing system of microorganisms; air and its constituent gases; dust, pollen and other particulates. The dispensing system also prevents evaporation of the fluid. Therefore, filters, antimicrobial preservatives, antioxidants and hygroscopic agents are not needed providing for substantial benefits in increased purity, increased ease of formulation, and reduction in cost. By continuously maintaining fluid purity during delivery, the system enables the distribution of larger sized containers thereby permitting a reduction in cost per unit volume of the fluid.

Examples of fluids that can benefit from the present invention include pharmaceutical preparations such as eye and lens care solutions; in vitro and in vivo diagnostic agents; biologicals; personal care preparations such as cosmetics and fragrances; foods, beverages; nutritional supplements and vitamins; industrial and laboratory chemicals; photographic solutions; detergents; paints, varnishes, adhesives and caulks and sealants.

The use of the present invention allows dispensed fluids to be packaged without chemical additives such as preservatives. This is advantageous because in some situations preservatives can have harmful side effects. Preservatives presently in use in eye and lens care solutions, for example, cause toxicity reactions and/or allergic reactions in eye tissues. Preservatives in prescription eye care products are known to adversely affect the post-surgery healing rate of eye tissues.

The present invention also provides increased purity and protection from contamination for laboratory chemicals and reagents such as photographic chemicals.

It will be clear to one skilled in the art that the above embodiment may be altered in many ways without departing from the scope of the invention. Accordingly, the scope of the invention should be determined by the following claims and their legal equivalents.

What is claimed is:

1. A one-way valve for dispensing a flowable material from a volumetrically reducible container and for preventing external contaminants from entering said container, said one-way valve comprising:

(a) a housing defining a flow path for the flowable material, and comprising an annular groove on the inside surface of said housing, said housing further comprising an inlet port connected to the volumetrically reducible container and an outlet port comprising an elastomeric material disposed for providing unidirectional flow of the flowable material outward along the flow path;

(b) a plug comprising an annular ring and at least one through-hole through the plug for enabling the flow of said flowable material along the flow path; and said plug is provided inside said housing such that said annular ring fits into said annular groove and said plug moves between a closed position and an open position with respect to the flow path;

(c) a means for applying a restoring force for returning said plug to said closed position such that said plug is moved from said closed position to said open position by applying sufficient internal pressure at said inlet port; and (d) wherein the means for applying a restoring force comprises deformation of an elastomeric tether disposed for holding the plug to open or to close the flow path.

2. A one way valve for dispensing a flowable material from a volumetrically reducible container and for preventing external contaminants from entering said container, said one-way valve comprising:

(a) a housing comprising an inlet port, an outlet port, and an annular groove on the inside surface of said housing;

(b) a plug comprising an annular ring, and at least one through-hole providing a path for the flow of said flowable material; said plug mounted inside said housing such that said annular ring fits into said annular groove and said plug moves between a closed position and an open position;

(c) a means for applying a restoring force for pushing said plug to said closed position; and said valve plug is moved from said closed position to said open position by internal fluid pressure of a certain threshold at said inlet port; and (d) wherein said plug is composed of a rigid material and is not fixedly connected to said housing, and the means for applying a restoring force is provided by deformation of at least one elastomeric tether contacting the plug.

* * * * *